US005461659A

United States Patent [19]

Siemers et al.

[11] Patent Number: 5,461,659

[45] Date of Patent: Oct. 24, 1995

[54] EMISSIVE COATING FOR X-RAY TUBE ROTORS

[75] Inventors: Paul A. Siemers, Clifton Park; Mark G. Benz, Burnt Hills; Stephen F. Rutkowski, Duanesburg, all of N.Y.; Mehran Mohsenian, Oconomowoc, Wis.

[73] Assignee: General Electric Company, N.Y.

[21] Appl. No.: 210,823

[22] Filed: Mar. 18, 1994

[51] Int. Cl.[6] ..... H01J 35/10

[52] U.S. Cl. ..... 378/129; 378/130; 378/131

[58] Field of Search ..... 378/119, 125, 378/127, 129, 131, 132, 142, 143, 144, 128, 130, 141, 199, 200, 202

[56] References Cited

U.S. PATENT DOCUMENTS

| | | | |
|---|---|---|---|
| 3,919,124 | 11/1975 | Friedel et al. | 378/143 |
| 3,993,123 | 11/1976 | Chu et al. | 165/80.3 |
| 4,029,828 | 6/1977 | Bildstein et al. | 378/143 |
| 4,090,103 | 5/1978 | Machenschalk et al. | 378/129 |
| 4,132,916 | 1/1979 | Hueschen et al. | 378/144 |
| 4,516,255 | 5/1985 | Petter et al. | 378/143 |
| 4,658,414 | 4/1987 | Geldner | 378/132 |
| 4,953,190 | 8/1990 | Kukoleck et al. | 378/129 |
| 5,150,397 | 9/1992 | Randzaao | 378/129 |

*Primary Examiner*—David P. Porta
*Assistant Examiner*—Don Wong
*Attorney, Agent, or Firm*—R. Thomas Payne; Paul R. Webb, II

[57] ABSTRACT

An improved high performance x-ray system having a rotating anode therein which includes an improved coating for the x-ray tube rotor. The surface of the x-ray tube rotor is coated with a ductile coating wherein at least about 40,000 x-ray scan-seconds are accomplished prior to tube failure due to spalling. The coating may be a ductile alloy such as Rene' 80 having a thickness of about 0.2 to about 5.0 mils thick and may be even thicker. The rotor coating has ductile properties with a strain to fail greater than 0.05% and thermal expansion properties which when placed on an x-ray tube rotor, provides at least about 40,000 x-ray scan-seconds prior to tube failure due to rotor spalling.

14 Claims, 5 Drawing Sheets

EMISSIVE COATING FOR X-RAY TUBE ROTORS

BACKGROUND OF THE INVENTION

The present invention relates to equipment for diagnostic and therapeutic radiology and methods of making the same and, more particularly, to a thermal emissive coating for x-ray tube rotors, such as those utilized in the GE Zeus x-ray tube.

One problem faced by x-ray tube designers has been related to the amount of heat generated during the x-ray generation cycle. Specifically, the silver lubricated bearings used with the anode rotor have, in the past, had a tendency to fail prematurely due to overheating from the tremendously high temperatures generated in the x-ray tube during peak power situations. Specifically, it is not uncommon for temperatures in the range of 700° C. to be generated in the vicinity of the silver lubricated bearing most proximate the rotating target. The problem related to rotor bearing overheating had been effectively solved utilizing an emissive coating on the anode rotor by plasma spraying a 0.001 inch thick oxygen deficient $TiO_2$ coating onto the rotor skirt.

With the recent tendency toward higher and higher power x-ray tubes and for nearly continuous twenty-four hour, seven day a week operations, another problem has developed with the anode rotor, that being material flaking from the surface of the rotor. This flaking or spallation of the brittle $TiO_2$ created fine particles that migrated to high electrical field regions of the tube, thus causing high voltage instabilities and arcing.

Recently, the problem related to rotor flaking had reached a critical point. Due to the tremendous load stresses undergone by the Zeus x-ray tube during continuous operation, the average Zeus life had been approximately 28,000 scan-seconds, utilizing the old $TiO_2$ rotor coating. Since an approximate 28,000 scan-second life did not even approach the 50,000 scan-second life per x-ray tube warranty and approximately 60% of the failures were due to flaking of the anode rotor, the need for an improved rotor having a coating that would eliminate the flaking while maintaining the effectiveness of the thermal emissive properties became apparent. Such a rotor coating composition desirably would provide sufficient thermal protection for the bearings and have sufficient emissive characteristics, while reducing significantly, if not eliminating, flaking of the rotor coating such that the average Zeus x-ray tube life would more closely approach the guaranteed 50,000 scan-seconds life warranty.

SUMMARY OF THE INVENTION

In carrying out the present invention in preferred forms thereof, we provide an improved x-ray tube rotor thermal emissive coating for use in x-ray tubes, such as those incorporated in diagnostic and therapeutic radiology machines, for example, computer tomography scanners. One illustrated embodiment of the invention disclosed herein, is in the form of an x-ray tube for the GE Zeus x-ray tube.

Each x-ray tube is normally enclosed in an oil-filled protective casing. A glass envelope contains a cathode plate, a rotating disk target and a rotor that is part of a motor assembly that spins the target. A stator is provided outside the tube proximate to the rotor and overlapping therewith about two-thirds of the rotor length. The glass envelope is enclosed in an oil-filled, lead-lined casing having a window for the x-rays that are generated to escape the tube. The casing in some x-ray tubes may include an expansion vessel, such as a bellows.

X-rays are produced when, in a vacuum, electrons are released, accelerated and then abruptly stopped. This takes place in the x-ray tube. To release electrons, the filament in the tube is heated to incandescence (white heat) by passing an electric current through it. The electrons are accelerated by a high voltage (ranging from about ten thousand to more than hundreds of thousands of volts) between the anode (positive) and the cathode (negative) and impinge on the anode, whereby they are abruptly slowed down. The anode, usually referred to as the target, is often of the rotating disc type, so that the electron beam is constantly striking a different point on the anode perimeter. The x-ray tube itself is made of glass, but is enclosed in a protective casing that is filled with oil to absorb the heat produced. High voltages for operating the tube are supplied by a transformer (not shown). The alternating current is rectified by means of rectifier tubes (or "valves") and in some cases by means of barrier-layered rectifiers.

For therapeutic purposes—e.g., the treatment of tumors, etc.—the x-rays employed are in some cases generated at much higher voltages (over 4,000,000 volts). Also, the rays emitted by radium and artificial radiotropics, as well as electrons, neutrons and other high speed particles (for instance produced by a betatron), are used in radio therapy.

In one specific embodiment of the present invention, an x-ray tube comprising: a glass envelope; a cathode operatively positioned in the glass envelope; an anode assembly including a rotor and a stator operatively positioned relative to the rotor; and a target operatively positioned relative to the cathode and the anode assembly, the rotor comprising: a relatively low coefficient of expansion metal inner core; a relatively higher coefficient of expansion outer core; and a ductile coating operatively covering the outer surface of the copper outer core wherein at least about 40,000 x-ray scan-seconds are accomplished prior to tube failure due to rotor coating failure is provided.

Another aspect of the present invention is embodied in an x-ray system comprising; an enclosure having oil contained therein; an oil pump, operatively positioned relative to the enclosure for circulating oil within the system; at least one cooling means, operatively connected to the enclosure and the oil pump, for cooling the oil; an x-ray tube, operatively positioned inside the enclosure, for generating the x-rays, the x-ray tube comprising: a glass envelope; a cathode, operatively positioned in the glass frame; an anode assembly including a rotor and a stator, operatively positioned relative to the rotor; and a target, operatively positioned relative to the cathode and the anode assembly, the rotor comprising: a metal, having an expansion coefficient similar to steel, inner core; a metal, having an expansion coefficient similar to copper, outer core; and a ductile, thermal emissive coating operatively covering the outer surface of the outer core wherein at least about 40,000 x-ray scan-seconds are accomplished before tube failure due to rotor coating spalling.

In one specific embodiment of the present invention, the ductile coating comprises: Rene' 80, a strong, ductile, highly adherent (to copper) superalloy whose oxides are emissive and are stable in the Zeus x-ray tube environment.

In another specific embodiment of the present invention, the ductile coating comprises: Rene' 80 coating from about 0.25 to about 5.0 mils thick.

One other aspect of the present invention includes a method of manufacturing the x-ray tube rotor used in the Zeus x-ray tube.

Accordingly, an object of the present invention is to provide an x-ray system including an improved x-ray tube having increased scan life.

Another object of the present invention is to provide an improved x-ray tube having a scan life of at least 40,000 scan-seconds.

A further object of the present invention is to provide an x-ray tube having an improved rotor coating, resistant to flaking.

A still further object of the present invention is to provide an emissive coating for an x-ray tube rotor that will prevent flaking for at least 40,000 scan-seconds.

Other objects and advantages of the invention will be apparent from the following description, the accompanying drawings and the appended claims.

DESCRIPTION OF THE PREFERRED EMBODIMENT

Figure 1:
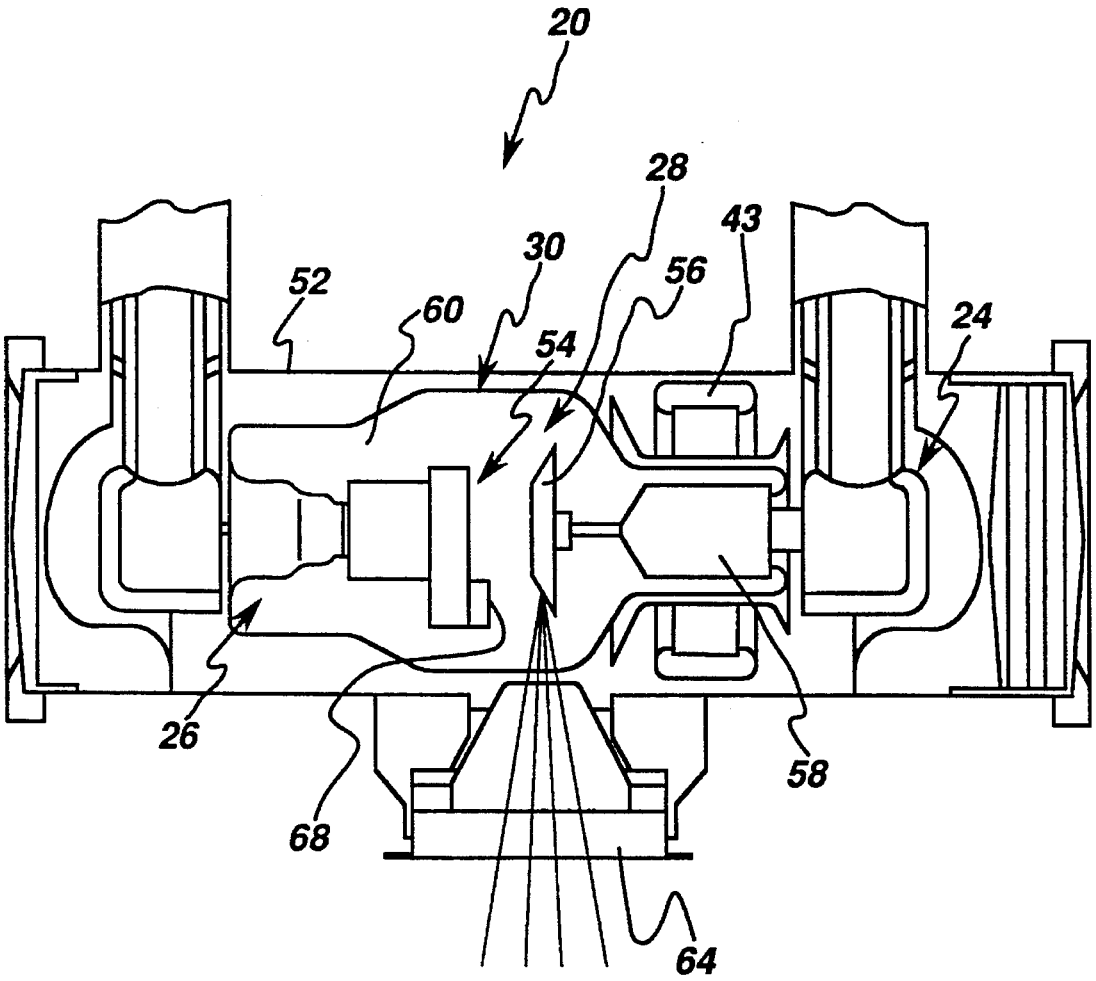
FIG. 1 is a schematic representation of a representative x-ray system having an x-ray tube positioned therein.
Figure 2A:
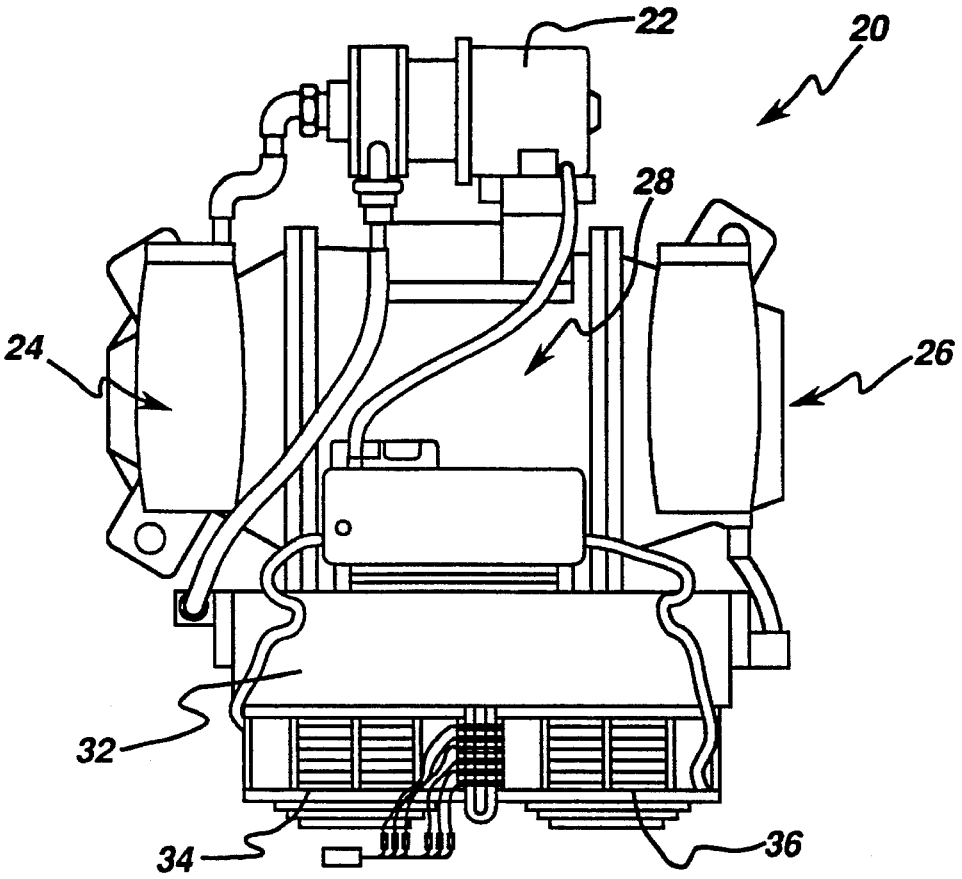
FIG. 2*a* is a plan view of another representative x-ray system.
Figure 2B:
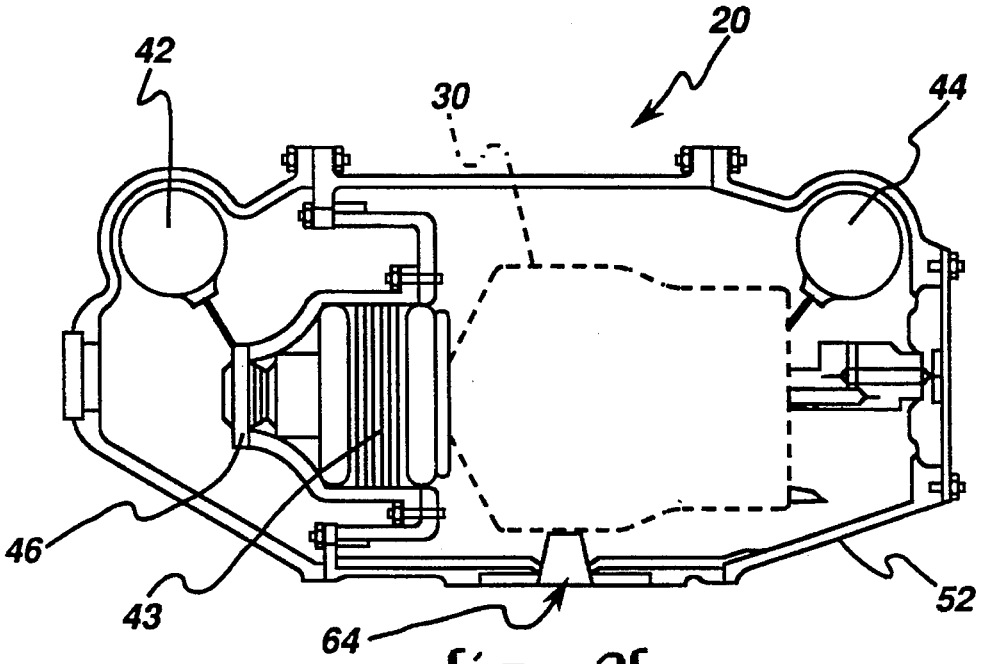
FIG. 2*b* is a sectional view with parts removed of the x-ray system of FIG. 2*a;*

An x-ray system embodying the present invention in one preferred form thereof is illustrated as generally designated by the numeral 20 in FIGS. 1, 2*a* and 2*b*. As can be seen, the system 20 comprises an oil pump 22, an anode end 24, a cathode end 26, a center section 28 positioned between the anode end and the cathode end, which contains the x-ray tube 30. A radiator 32 for cooling the oil is positioned to one side of the center section and may have fans 34 and 36 operatively connected to the radiator 32 for providing cooling air flow over the radiator as the hot oil circulates therethrough. The oil pump 22 is provided for circulating the hot oil through the system 20 and through the radiator 32, etc. As shown in FIG. 2*b*, electrical connections are provided in the anode receptacle 42 and the cathode receptacle 44.

As shown in FIG. 1, the x-ray system 20 comprises a casing 52 preferably made of aluminum and lined with lead and a cathode plate 54, a rotating target disc 56 and a rotor 58 enclosed in a glass envelope 60. A stator 43 is positioned outside the glass envelope 60 inside the lead lined casing 52 relative to the rotor 58. The casing 52 is filled with oil for cooling and high voltage insulation purposes as was explained above. A window 64 for emitting x-rays is operatively formed in the casing 52 and relative to the target disc 56 for allowing generated x-rays to exit the x-ray system 20.

As stated above, very high voltages and currents are utilized in the Zeus tube and range from an approximate voltage maximum 120 kV to an approximate minimum of 80 kV and from an approximate current maximum of 400 ma to an approximate minimum of 250 ma.

Figure 3:
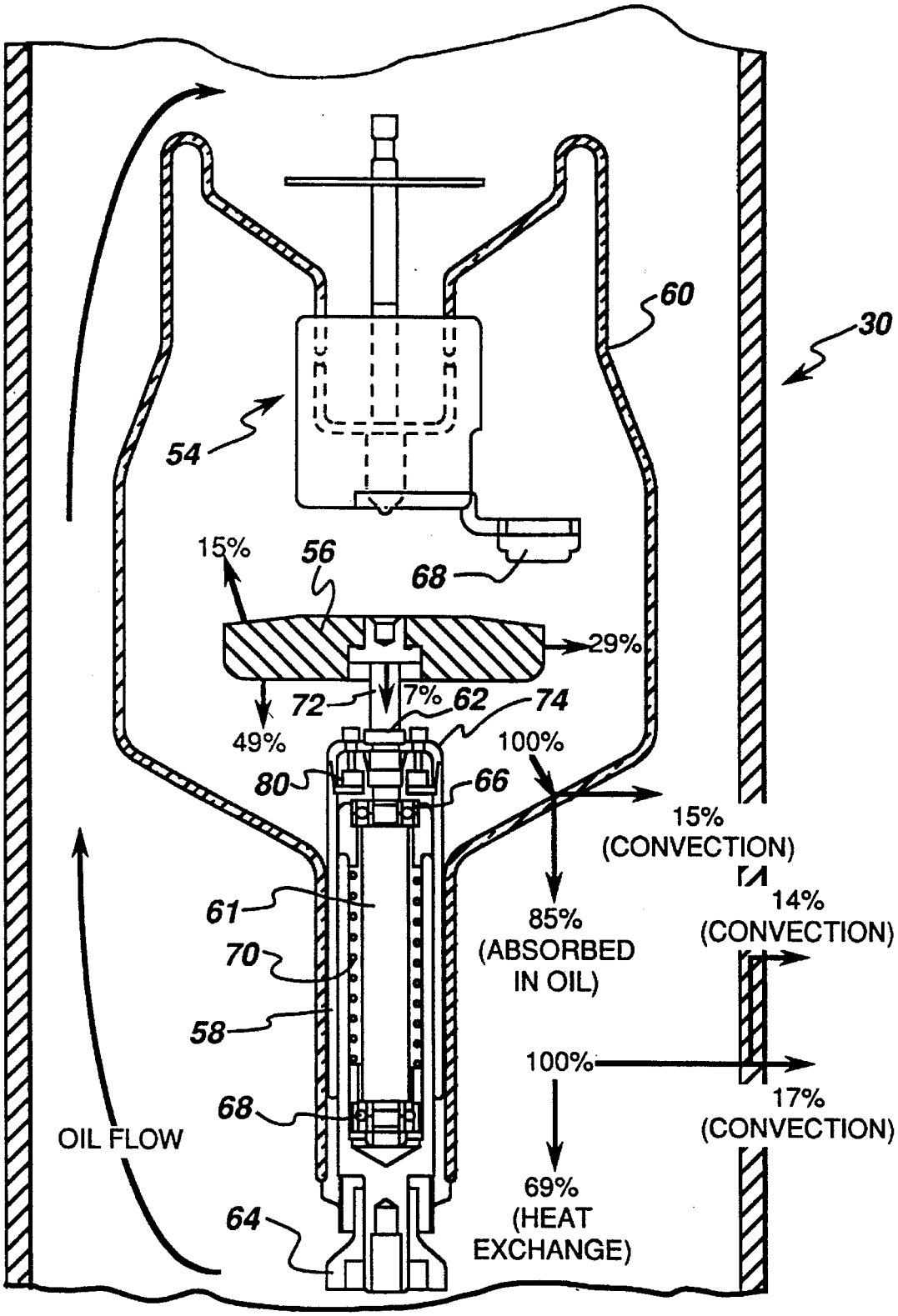
FIG. 3 is a partial sectional view of an x-ray tube illustrating representative thermal paths.
Figure 4:
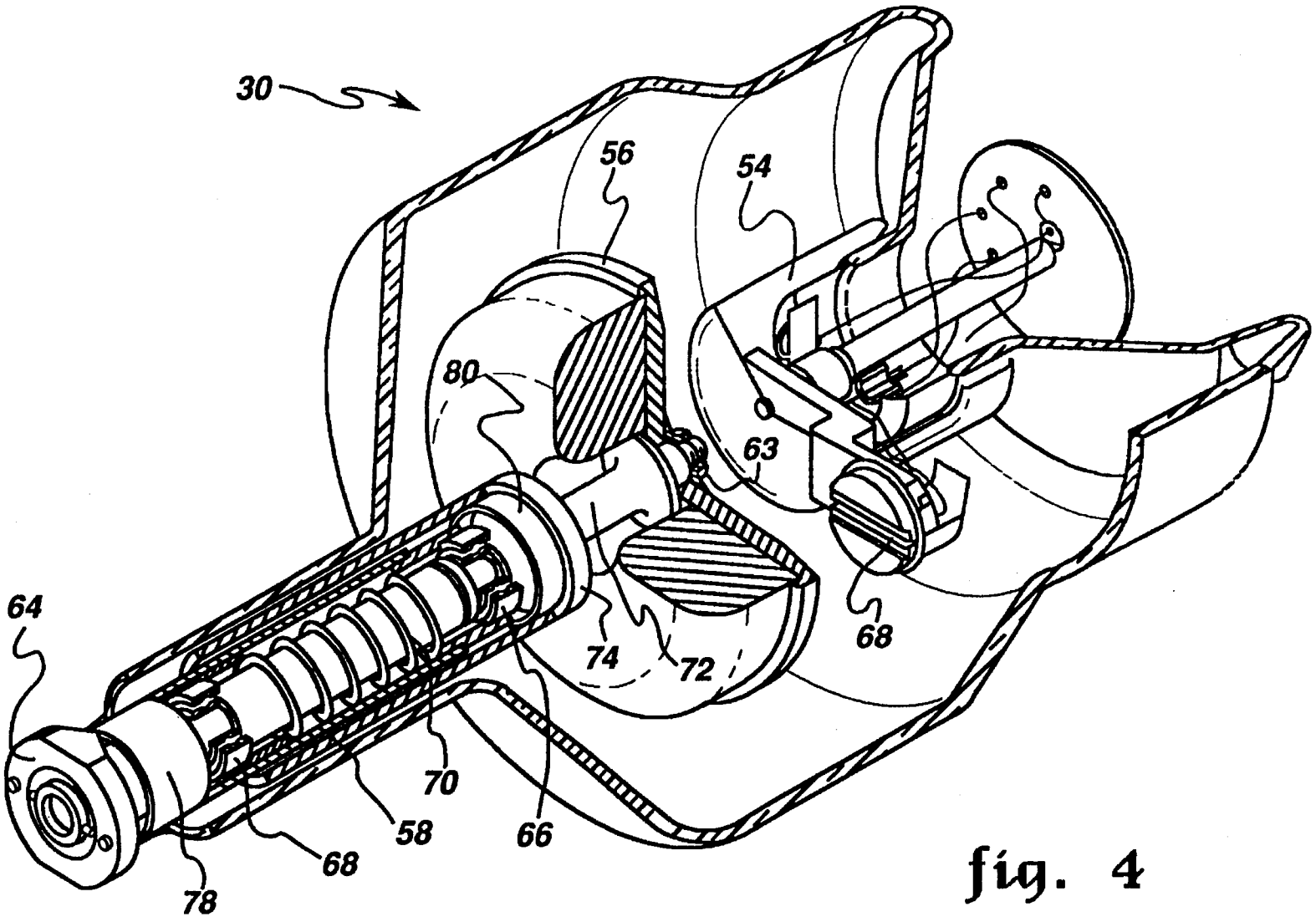
FIG. 4 is a partial perspective view of a representative x-ray tube with parts removed, parts in section, and parts broken away.

As shown in FIGS. 3 and 4, the cathode 54 is positioned inside the glass envelope 60. As is well known, inside the glass envelope there is a vacuum of about $10^{-5}$ to about $10^{-9}$ torr. The electricity generates x-rays that are aimed from the cathode filament 68 to the anode target or the top of the target disc 56. The target disc is operatively connected to a rotating shaft 61 at one end by a Belleville nut 63 and by another nut at the other end 64. A front bearing 66 and a rear bearing 68 are operatively positioned on the shaft 61 and are held in position in a conventional manner. The bearings 66 and 68 are usually silver lubricated and are susceptible to failure at high operating temperatures.

A preload spring 70 is positioned about the shaft 60 between the bearings 66, 68 for maintaining load on the bearings during expansion and contraction of the anode assembly. A rotor stud 72 is utilized to space the end of the rotor most proximate the target 56 from the rotor hub 74. The bearings, both front 66 and rear 68, are held in place by bearing retainers 78 and 80. The rotor assembly also includes a stem ring and a stem all of which help to provide for the rotation of the rotor 58 with the target 56.

The temperature in the area of the filament 68 can get as high as about 2500° C. Other temperatures include about 1100° C. near the center of the rotating target 56, which rotates at about 10,000 rpm. Temperatures of the focal spot on the target 56 can approximate 3200° C. and temperatures on the outside edge of the rotating target 56 approach about 1300° C. The temperature in the area of the rotor hub 74 approach 700° C. and of the front bearing 66 approaches 450° C. maximum. Obviously, as one moves from the target 56 to the rotor 58 and stator 43 (see FIG. 1), the temperature appears to decrease. It has recently been found that temperatures on the surface of the rotor 58 can approach up to 700° C.

During operation of some x-ray systems having the GE Zeus x-ray tube, severe protocols users have maximized usage of the system by making as many scans at high peak power in as short a time as possible. One of the problems with utilizing any x-ray system in this continuous type of operation is the amount of heat that is generated, which may in fact destroy the silver bearings 66, 68, especially the front bearing 66.

If the x-ray tube target 56 and rotor 58 were allowed to continue to rotate at 10,000 rpm between scans, the bearings would wear out prematurely and cause the tube to fail. Thus, if it appears that there would to be more than 60 seconds between scans, the x-ray system operating control system software is programmed to brake the rotor by rapidly slowing it completely down to zero (0) rpm. However, when ready to initiate a scan, the control system software is programmed to return the target and the rotor to about 10,000 rpm as quickly as possible. These rapid accelerations and brakes are utilized because, among other reasons, there are a number of resonant frequencies that must be avoided during the acceleration from zero (0) to 10,000 rpm and the brake from 10,000 rpm to zero (0) rpm. In order to pass through these resonant frequencies both immediately before a scan or a series of scans and after a scan or series of scans as fast as possible, the x-ray system applies maximum power to bring the target, or anode, to 10,000 rpm or down to zero (0) rpm in the least amount of time possible.

It should be noted that the x-ray tube target and rotor can be accelerated to 10,000 rpm from a dead stop in about 12 to about 15 seconds and slowed down at about the same rate.

Vibration from the resonant frequencies is a real problem, if the tube is allowed to spin to a stop without braking.

It has been found that during these rapid accelerations to 10,000 rpm and the immediate braking from 10,000 rpm to zero, stresses, mechanical as well as thermal, impact on the rotor 58. These stresses have resulted in portions of the $TiO_2$ coating on the rotor surface flaking in the portion of the rotor most proximate the stator where motor losses and heating are greatest. These fine particles or flakes have been found to be attracted to high electrical fields, such as the cathode 54 and to adhere electrostatically thereto.

Due to these flakes being attracted to the cathode 54, problems have developed relating to the disturbances caused by high voltage arcing, which are initiated from negative areas that have resulted in the necessity to repeat the scans when such arcing and instabilities occur during an x-ray scan.

As is well known, the surface of the cathode 54 in an x-ray tube 30 is designed to be extremely smooth and have no jutting components because if one point is even slightly higher than another, high electric fields result which can arc from the high point. This particular phenomenon is the reason the flaking of the coating of the rotor 58 and its migration to the high electrical field regions of the x-ray tube 30 and, in particular, the cathode 54 have resulted in a high incidence of GE Zeus x-ray tube failures (approximately 60% to about 70% because of high voltage instability). Thus, there is a need for a rotor that has a coating having acceptable emissivity that prevents the flaking during severe protocols usage.

Figure 6:
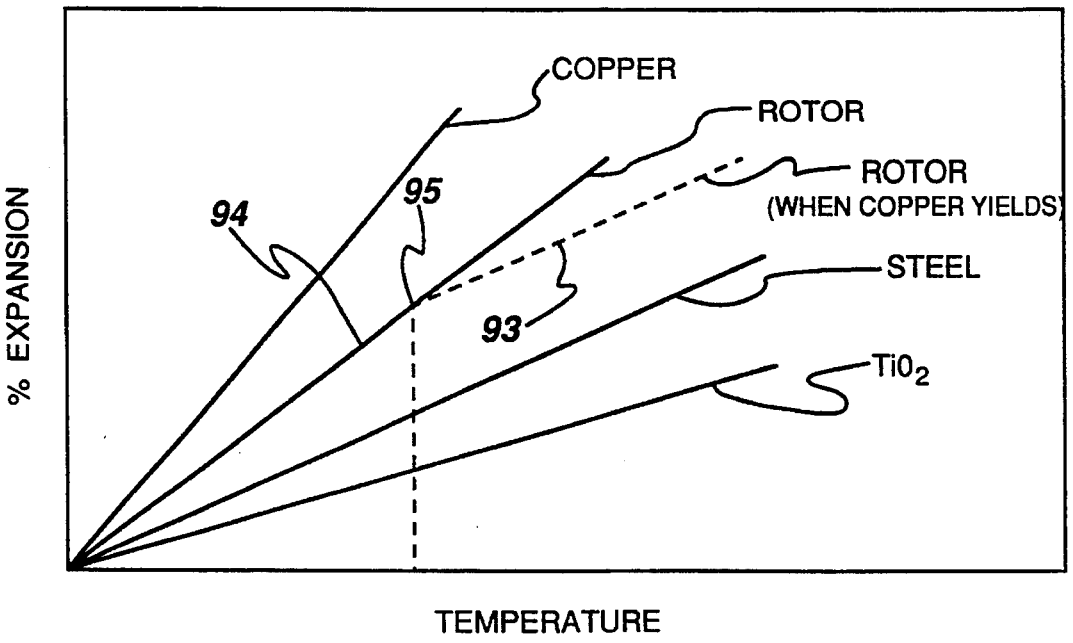
FIG. 6 is a graphic representation of the approximate thermal expansion of representative materials used in x-ray tube rotors.

One additional key to the stability of the rotor and especially to the prevention of coating flaking during severe protocols usage is the relative coefficient of expansion between the steel, the copper and the coating. As shown in FIG. 6, copper has a thermal expansion factor of about $18\times10^{-6}$ $K^{-1}$ and steel has a thermal expansion factor of about $12\times10^{-6}$ $K^{-1}$. The previously used $TiO_2$ coating had a thermal expansion of about $8\times10^{-6}$ $K^{-1}$ that is approximately one-half of copper.

It had been found that field Zeus x-ray tube rotors had ruptured outer surfaces that were initially believed to have led to the flaking of the $TiO_2$ coating. In order to overcome these initial flaking problems, which appeared to be related to the rupture of the copper outer surfaces, a specific copper alloy was used called GLIDCOP™, a trademark of the SCM Corp., (oxide dispersion strengthened copper). GLIDCOP™ has about ninety-two percent of the electrical and thermal properties of copper and has about the same thermal expansion as copper, but has 8–10 times the yield strength of copper.

FIG. 6 illustrates the expansion of the regular copper combined with the steel. Specifically, at the point where line 94 splits into line 93, is the temperature where it is believed stress in the copper exceeds its yield point, thus the rotor with the normal copper yields and its thermal expansion coefficient is equivalent to line 93 as temperature rises. When using copper with GLIDCOP™, represented by line 94 beyond the point 95, it is believed the copper with GLIDCOP™ has a relatively high thermal expansion coefficient because the GLIDCOP™ does not yield like the copper. The utilization of the GLIDCOP™ appeared to solve the x-ray tube ruptured rotor outer surface problem but, in fact, it is believed that it made the $TiO_2$ coating flaking worse. Since the effective thermal expansion of the copper-steel rotor is lower than the effective GLIDCOP™ steel rotor thermal expansion because the GLIDCOP™ does not yield like copper during tube operations, as indicated in FIG. 6, the $TiO_2$ coating flaking problem was made worse due to the GLIDCOP™-steel combination.

Figure 5:
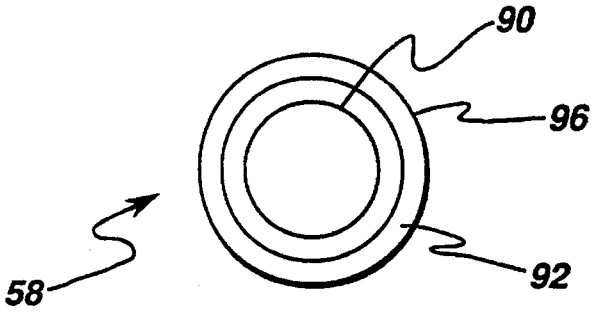
FIG. 5 is a sectional view of an x-ray tube rotor showing the composition thereof.

With specific reference now to FIG. 5, the rotor 58 of the present invention, in one form thereof, preferably comprises a 1018 steel inner member 90 having a copper outer member 92 operatively connected thereto by means such as brazing. It should be understood that, while FIG. 5 shows the steel as being relatively thicker than the copper, the steel and copper components, as actually used in production rotors, are preferably approximately the same thickness. It is believed that numerous metals in numerous relative thickness combinations may be operable to provide a satisfactory rotor construction.

In order to manufacture the rotor 58, a hollow steel cylinder member, such as 1018 steel, is electroplated with gold braze. A complementary hollow copper member is positioned over the steel cylinder with the outer surface of the steel and inner surface of the copper cylinders touching. The combined cylinders are placed in a TZM molybdenum die to constrain the expansion of the outer copper so that the copper and steel maintain contact during high temperature brazing, usually done in a vacuum.

After rotor machining, the outer surface of the copper member 92 is coated with a thermal emissive coating 96 for radiating excessive heat from the rotor, such that the rotor 58 is prevented from flaking or spalling during extreme protocols operation.

In a preferred embodiment of the present invention, the coating 96 applied to the rotor was an air plasma sprayed nickel base superalloy coating, such as Rene' 80 or NiCrAlY. These coatings appear to have an emissivity of about 0.71 to about 0.79. While this emissivity is less than the prior $TiO_2$ coatings, in a field test, at least one Zeus x-ray tube, in severe protocols usage having the Rene' 80 coating experienced no flaking, after approximately 63,000 scan-seconds. Also, no flaking occurred during in-house oil box and gantry testing. Because the nickel based superalloyed coatings are metallic, they have some ductility, which, apparently, prevent the rotor 58, having a Rene' 80, coating from rupturing at the surface and flaking thereby preventing the problem with arcing mentioned above. Also, Rene' 80 has a better expansion match (approximately the same as copper) with the rotor, which also may most likely contribute to the prevention of coating flaking.

EXAMPLE 1

Flat copper substrates were grit blasted (or sand blasted) with 60 mesh aluminium oxide. The emissivity of grit blasted copper is about 0.2 to about 0.3. The substrates were cleaned and degreased, such as by ultrsonic means, in methyl chloroform solvent for about 10 minutes. The substrates were conventionally plasma sprayed in air using −140+270 mesh, and −400 mesh Rene' 80 (Ni-14Cr-9.5Co-5Ti-4-Mo-4W-3A1-0.17C-0.03Zr-0.015B, composition in weight percent) powder. During one spray trial, oxygen was substituted for argon as the powder carrier gas.

The emissivity of the Rene' 80 coatings was measured by heating each substrate to about 150°–200° C. on a hot plate. On one side of the sample a piece of black electrical tape (emissivity of about 0.96) was attached, which served as a reference surface. The radiation emitted from the coating and the electrical tape was observed using an Agena Thermovision Model 970 SW/TE IR imaging camera. The spectral response of the camera is about 2.0–5.6 microns. The emissivity was calculated by dividing the photon flux of the radiation emitted from the electrical tape into the photon flux of the radiation emitted from the coating and multiplying the result by the emissivity of the electrical tape (0.96).

For reference purposes, the emissivity of a $TiO_2$ coating on copper, fabricated at the tube production facility was also measured. Table 1 gives the results of these measurements.

TABLE 1

Emissivity of Air Plasma Sprayed Metal Coatings on Flat Copper Substrates

| Material | Emissivity |
|---|---|
| plasma sprayed $TiO_2$ | 0.86 |
| Rene' 80 −140 + 270 mesh | 0.58 |
| Rene' 80 −140 + 270 mesh | 0.63 |
| Rene' 80 −400 mesh | 0.73 |
| Rene' 80 −400 mesh | 0.69 |
| Oxygen added to carrier gas | |

These initial trials focused on evaluating the effects of powder particle size and partial oxidation of the powder on the emissivity. Rene' 80 was chosen as the alloy system, because a range of powder sizes was readily available. Two deposits of the −140+270 mesh Rene' 80 were fabricated using slightly different torch conditions, hence two values of emissivity are given in the table. The trials were extremely encouraging in that finer powders yielded higher emissivity coatings. Adding oxygen to the carrier gas did not seem improve the emissivity of the finest powder. We were surprised by the high emissivity (0.73) of the −400 mesh Rene' 80 coating.

EXAMPLE 2

On the basis of the above discovery, six tube quality rotors were coated with three variations of coatings, which included plasma sprayed −400 mesh Rene' 80, plasma sprayed NiCrAlY (Ni-22Cr-10Al-1Y by weight) and plasma sprayed NiCrAlY over coated with plasma sprayed $TiO_2$. We also coated flat copper substrates with these coatings so that our initial emissivity measurements could be verified. Scrap rotors were used to establish the desired spray conditions before coating the six tube quality rotors.

We determined the emissivities of the coatings on actual rotors in two separate locations using the IR camera technique described earlier. Table 2 shows the emissivities of rotors with each coating variation. Table 2 also shows the measured emissivity of a GE Medical Systems rotor plasma sprayed with the then production oxygen deficient $TiO_2$ coating.

TABLE 2

Emissivity of Plasma Sprayed Zeus Rotors

| Material | Emissivity | |
|---|---|---|
| GEMS plasma sprayed $TiO_2$ | 0.91 | 0.90 |
| Rene' 80 −400 mesh | 0.90 | 0.89 |
| NiCrAlY −400 mesh | 0.76 | 0.76 |

Note that the emissivities of the same plasma sprayed coatings are much higher in Table 2 than Table 1. It was initially believed there may have been angle of incidence effects associated with deposition onto the cylindrical substrates that did not occur on the flat substrates. When both the flat and curved Rene' 80 and $TiO_2$ coatings were viewed under a scanning electron microscope, no striking differences in surface features were observed.

One important aspect of the emissivity data in Table 2 is that, for these coatings, there is virtually no difference in emissivity between the GE Medical Systems plasma sprayed $TiO_2$ and the Rene' 80 coatings. If the tube tests 80 prove Rene' to be a durable coating, it should be an excellent substitute for the $TiO_2$ coating.

EXAMPLE 3

Vacuum Thermal Cycling Test

Vacuum thermal cycling tests were used, in two separate locations, to evaluate the thermal shock resistance of candidate emissive coatings. At one location, a RF coil in a bell jar with a hydrogen atmosphere was installed. Using RF, a rotor coated with $TiO_2$ was heated to 930° C. and allowed it to cool to room temperature. The temperature was monitored using a two color infra-red pyrometer. After three cycles the $TiO_2$ coating began spalling. A plasma sprayed Rene' 80 coating did not spall after six thermal cycles.

At the second location, a similar test was developed, except that the RF coil was in a vacuum instead of hydrogen. At the second location, the temperature was measured using type K thermocouples instead of an infra-red pyrometer. The RF heating source was a 5 kW Lepel induction heater operating at about 200–500 kHz through a 4:1 step down transformer. About 13 turns of partially flattened 3/16 inch copper tubing were required to obtain good coupling to the rotor. The coils covered the lower ⅔ of the rotor skirt. Rotor temperatures were measured using three thermocouples mounted on the rotor. Two of them were about 1 inch from the skirt opening, located 90° apart. The third thermocouple was attached to the IN-718 thermal barrier at the top of the rotor. After the first trials, it was determined that the thermocouples near the skirt differed by only a few degrees centigrade, hence one of the thermocouples was eliminated. The temperatures during heating and cooling were recorded using a Data Translations data logging card installed in a PC clone using software and equipment that were developed at the second location.

A typical cycle consisted of heating the rotor from room temperature to 930° C. and then allowing the rotor to cool to about 100° C. During the heating cycle, it took about 2 minutes for the thermocouple near the rotor skirt (the part of the tube under the coil) to achieve 930° C. The power is kept on for an additional 7 minutes (for a total of 10 minutes) to allow the temperature at the thermal barrier to equilibrate at about 765° C. For the $TiO_2$ and the Rene' 80 coated samples the cooling time was about 50 minutes.

Four (4) rotors were evaluated using the thermal cycling test. The standard $TiO_2$ coated rotors began flaking after 3 or 4 thermal cycles. This result is consistent with that found the first location, suggesting that the hydrogen environment used there does not alter the failure of the coating. We also cycled a Rene' 80 coating 9 times without any spallation. This suggests that the Rene' 80 will not fail via a spallation mechanism.

During each of the thermal cycles just described, the temperature of the rotor was measured as a function of time. Using these data, the amount of time that was required to cool from 700° C. to 500° C. and to cool from 700° C. to 400° C. was determined. The temperature data from the control thermocouple near the skirt of the rotor was used. All of the rotors had a mass of about 410–420 grams, hence the heat capacities of the rotors were the same. Table 3 summarizes the results of these determinations and also includes the measured emissivity of each coating system.

TABLE 3

| Cooling Time of Rotors with Different Coatings | | | | |
|---|---|---|---|---|
| Coating Type | Run Number | Time (sec) 700–500° C. | Time (sec) 700–400° C. | Measured Emissivity |
| $TiO_2$ | 1 | 183 | 370 | 0.91 |
| | 2 | 194 | 387 | |
| | 3 | 196 | 390 | |
| | 4 | 194 | 386 | |
| | | Avg. = 192 ± 6 | Avg. = 383 ± 9 | |
| Rene' 80 | 1 | 196 | 389 | 0.90 |
| | 2 | 194 | 390 | |
| | 3 | 195 | 388 | |
| | 9 | 193 | 384 | |
| | | Avg. = 195 ± 1 | Avg. = 388 ± 3 | |
| Uncoated | 1 | 826 | 1,627 | 0.2 |

The data in Table 3 indicate that the cooling times for each coating were consistent. The cooling times of the Rene' 80 and the $TiO_2$ were surprisingly similar. The measured emissivities of Rene' 80 and $TiO_2$ on rotors are nearly the same. It is interesting to note that an uncoated rotor takes about 4.2 times longer than for the Rene' 80 or $TiO_2$ to cool from the same temperatures. This is about the same as the ratio of the emissivity of the Rene' 80 to that of the copper. The cooling time is a good indicator of any change in emissivity that may occur as a result of thermal cycling. Note that the cooling time for the 9th cycle for the Rene' 80 is about the same as the other cycles, which suggests that the emissivity of the Rene' 80 is not degrading during cycling.

As a result of the above, a plan was developed to heat treat the Rene' 80 tube in vacuum for 24 hours at 930° C. and then re-measure the cooling curve of the tube. If there is no change, it would indicate that the emissivity of the Rene' 80 is stable with time at elevated temperature.

EXAMPLE 4

As shown in table 3, a rotor coated with Rene' 80 was cycled nine times to 930° C. without any spallation or degradation of its emissivity. After inspection, the same tube was cycled to 930° C. a tenth time to verify that its cooling curve was about the same as the previous cycles. The same tube was heated to 930° C. an eleventh time and held at temperature in vacuum for 21 hours. After the heat treatment the rotor's cooling curve was measured and compared to the previous curves. Table 4 shows the results of those determinations. Also included in table 4 are the cooling curve results for $TiO_2$ and uncoated rotors that were included in table 3.

The data in Table 4 shows that the time to cool from 700°–500° C. and 700°–400° C. has increased significantly after the 21 hour heat treatment in vacuum. Based on the change in cooling rate, the emissivity of the coating was calculated to be about 0.74 (later confirmed by actual measurement), an 18% reduction in emissivity from the original value of 0.90. After heat treatment, inspection of the Rene' 80 coating showed that it was still adherent, but its color had changed to a lighter "coppery" color. It is believed that the GLIDCOP™ copper substrate and the Rene' 80 may have partially interdiffused during heat treatment, thus reducing the emissivity of the Rene' 80. This is a possible failure mechanism of the Rene' 80 emissive coating system. Fortunately, the 21 hour exposure at 930° C. is not expected to occur during Zeus x-ray tube operation, or any other known x-ray tube, and represents a severe thermal exposure.

TABLE 4

| Cooling Time of Rotors with Different Coatings | | | | |
|---|---|---|---|---|
| Coating Type | Run Number | Time (sec) 700–500° C. | Time (sec) 700–400° C. | Measured Emissivity |
| $TiO_2$ | 1 | 183 | 370 | 0.91 |
| | 2 | 194 | 387 | |
| | 3 | 196 | 390 | |
| | 4 | 194 | 386 | |
| | | Avg. = 192 ± 6 | Avg. = 383 ± 9 | |
| Rene' 80 | 1 | 196 | 389 | 0.90 |
| | 2 | 194 | 390 | |
| | 3 | 195 | 388 | |
| | 9 | 193 | 384 | |
| | | Avg. = 195 ± 1 | Avg. = 388 ± 3 | |
| | 10 | 184 | 366 | |
| | 11 (930° C. 21 h) | 221 | 440 | 0.74 |
| Uncoated | 1 | 826 | 1,627 | 0.2 |

The automatic features of the thermal cycling rig was used to investigate the effect of temperature cycle on the life of $TiO_2$ coated rotors. In one test, a $TiO_2$ coated rotor was heated to 800° C. and cooled to room temperature two times. Inspection of the rotor indicated that the $TiO_2$ had spalled from a large fraction of the rotor. A second $TiO_2$ coated rotor was exposed to the same temperature a total of 53 cycles without any spallation. These results indicate that there is a large variability in the adhesion of the titania to the GLIDCOP™. The pedigree of each rotor was not known, but each rotor had been obtained from factory shrinkage of Zeus tubes, hence the rotors were exposed to seasoning cycles only.

EXAMPLE 5

Next, process sensitivity studies were conducted to evaluate the effect of gun to work distance, substrate composition (GLIDCOP™ vs. copper), gun traverse rate, powder feed rate, the use of secondary gases (hydrogen vs. no hydrogen), and deposit thickness on the emissivity of Rene' 80 deposits. Table 5 compares the emissivity of as-sprayed Rene' 80 to the process variables that were used. Most of the deposits (Runs 1–12) were made using a gun translation mechanism to obtain reproducible traverse rates and gun to substrate distances. The substrates were OFHC copper tubes 1.313 inches in diameter. Production rotors are 1.440 inches in diameter. Except as where noted (Run 19), the rotation rate was held constant at 100 rpm and the substrate was grit blasted.

The original intent of the sensitivity study was to establish a baseline spray process that had been used to coat the original rotors that were evaluated at the first location in their oil box and gantry tests at the factory. Those original coatings had been applied by hand spraying instead of using a machine.

After establishing a baseline, it was intended to vary each parameter by a factor of 2 higher and lower than the baseline. In some cases it was not practical to vary an individual parameter by such a large amount, hence appropriate adjustments were made.

Run 1 was the first attempt at obtaining a Rene' 80 coating similar to that obtained by hand spraying. The traverse rate of 2 inches per second was too high and the number of passes was too large. The net result was an unevenly coated specimen with a coating that was much thicker than originally intended. Run 2 was believed to be a good representation of the spray conditions and coating thickness that was being fabricated in factory production. Run 3 is a good representation of the coating thickness (about 1.0–1.5 mils) that was used at the time the first rotors were produced. Runs 2–4 show the effect of coating thickness on as-sprayed emissivity. The emissivity only varied between 0.71 and 0.74. Thinner coatings appeared to be slightly better than thicker coatings. Runs 5 and 6 varied the powder feed rate from the baseline. The slower powder feed rate did not significantly change the emissivity of the as-sprayed Rene' 80. Again, the thinner coating (Run 5) seemed to yield a slightly higher emissivity.

Runs 7–12 did not use any hydrogen as a secondary gas. Also varied in these runs were the gun to work distance and the thickness of the deposit. The powder feed rate used was 32 grams per minute. The data in Table 5 suggest that the use of hydrogen is important to obtaining higher emissivity. The average emissivity of Runs 1–6 (using hydrogen) was 0.72±0.02 and the average emissivity of Runs 7–12 (no hydrogen) was 0.69±0.02. For the deposits made without hydrogen, coating thickness and gun to work distance did not appear to be important variables relative to the as-sprayed emissivity.

It should be noted that Runs 1–12 were made over a period of two days followed by emissivity measurements. At that time it was believed that the emissivity of Rene' 80 was about 0.89 (one measurement) when it was deposited on a round substrate and was about 0.73 (several measurements, some confirmed by the other location) when it was deposited on a flat substrate. The substrates used in Runs 1–12 were round copper substrates and emissivities approaching 0.89 were expected. Runs 13–21 were attempts to achieve the higher emissivity.

Runs 13–15 were attempts to spray the Rene' 80 exactly as it was done in Example 1. The deposits were hand sprayed. Both the thickness and substrate were varied. The emissivity data suggest that thin Rene' 80 (1 mil) on grit blasted GLIDCOP™ yielded a slightly higher emissivity (0.80) than the same material on copper (0.77). The effect disappeared when the thickness of the Rene' 80 was increased to 5 mils. It is believed that the higher strength GLIDCOP™ yields a more favorable surface for high emissivity when it is grit blasted. The thicker coatings probably covered and did not replicate this favorable surface.

Runs 13–15 do suggest that hand spraying yields slightly higher emissivities than does machine spraying. Discussions with the technician, who did the spraying, suggest that a human adapts his spray technique based on the appearance of the coating to obtain a more uniform coating.

TABLE 5

Plasma Process Variables vs. As-Sprayed Emissivity for Rene' 80

| Run | Substrate | Gun to Work (inches) | Traverse Rate (in./s) | Passes | Powder Feed Rate (g/min.) | $H_2$ (%) | Thick (mils) | Emissivity |
|---|---|---|---|---|---|---|---|---|
| 1 | copper | 5 | 2 | 20 | 32 | 10 | 5 | 0.70 |
| 2 | copper | 5 | 0.5 | 2 | 32 | 10 | 2.5 | 0.71 |
| 3 | copper | 5 | 0.5 | 1 | 32 | 10 | 1.5 | 0.74 |
| 4 | copper | 5 | 0.5 | 4 | 32 | 10 | 5 | 0.72 |
| 5 | copper | 5 | 0.5 | 2 | 9 | 10 | 1.0 | 0.74 |
| 6 | copper | 5 | 0.5 | 4 | 9 | 10 | 1.2 | 0.72 |
| 7 | copper | 5 | 0.5 | 8 | 9 | none | 2.5 | 0.71 |
| 8 | copper | 5 | 0.5 | 2 | 32 | none | 1.5 | 0.69 |
| 9 | copper | 5 | 0.5 | 4 | 32 | none | 2.5 | 0.71 |
| 10 | copper | 3 | 0.5 | 4 | 32 | none | 2.5 | 0.68 |
| 11 | copper | 3 | 0.5 | 2 | 32 | none | 1.5 | 0.68 |
| 12 | copper | 3 | 0.5 | 1 | 32 | none | 1.5 | 0.71 |
| 13 | copper | 5 | hand spray | 2 | 32 | 10 | 1.0 | 0.77 |
| 14 | GLIDCOP ™ | 5 | hand spray | 2 | 32 | 10 | 1.0 | 0.80 |
| 15 | GLIDCOP ™ | 5 | hand spray | 6 | 32 | 10 | 5.0 | 0.77 |
| 16 | | 5 | hand spray | 6 | 32 | 10 | 5.0 | 0.77 |
| 17[1)] | GLIDCOP ™ | 5 | hand spray | 6 | 32 | 15 | 2.0 | 0.79 |
| 18[1)] | GLIDCOP ™ | 5 | hand spray | 6 | 32 | 10 | 2.0 | 0.79 |
| 19a[2)] | GLIDCOP ™ | 5 | hand spray | 3 | 32 | 10 | 2.0 | 0.71 |
| 19b[3)] | GLIDCOP ™ | 5 | hand spray | 3 | 32 | 10 | 2.0 | 0.75 |
| 19c[4)] | GLIDCOP ™ | 5 | 0.5 | 2 | 32 | 10 | 2.0 | 0.67 |
| 19d[5)] | GLIDCOP ™ | 5 | 0.5 | 2 | 32 | 10 | 2.0 | 0.64 |

Conditions: 100 rpm rotation rate, grit blasted substrate. Gun was moved using a michine.
[1)]Surface was bead blasted instead of grit blasted.
[2)]Hand sprayed. Only horizontal passes. Rotation was indexed. Substrate was round.
[3)]Only horizontal passes. Rotation was indexed. Flat area machined on round substrate.
[4)]Maching sprayed. Flat area machined on round surface. Substrate was rotated. Gun was translated.
[5)]Machine sprayed. Round area. Substrate was rotated 100 rpm. Gun was translated.
[6)]Rotation and gun translation were at maximum rates. Copper could be seen through coatings.

Runs 17 and 18 were designed to test the effect of surface pre-treatment and higher hydrogen levels. Adding 50% more hydrogen to the gas mixture did not change the emissivity nor did bead blasting the surface instead of grit blasting change the emissivity. It is clear from runs 13–18 that hand sprayed tubes are higher emissivity than the machine sprayed tubes.

Run 19 was an attempt to discern the effect of spraying on flat vs. round substrates and rotating vs. non-rotating substrates. A ½ inch wide flat across a GLIDCOP™ rotor was milled therein. One half of the rotor was masked from the spray. For runs 19a and 19b the rotor was sprayed by hand using only horizontal passes. After each horizontal pass, the rotor was indexed until it was completely coated. Runs 19c and 19d were performed on the other half of the same rotor. The substrate was rotated at 100 rpm and the gun was translated by machine. The data for run 19 suggests that the emissivities of the round areas (no machined flat) were slightly lower than the flat areas. The machine sprayed areas had a lower emissivity than the hand sprayed area.

Since "dusting" has been observed on some of the early tubes produced at GEMS both at other locations, tape tests were performed on all of the coatings made during the process sensitivity studies. Dusting is essentially a small amount of unmelted or evaporated and re-condensed powder that can be trapped on the surface of a Rene' 80 coating after spraying. If the dust is significant scotch tape will remove some of it. None of the tubes produced in the process sensitivity study showed any residual dust. This included the coatings that were produced without hydrogen.

EXAMPLE 6

One production quality rotor with Rene' 80 coating was received from the GE factory. As a result of early spray parameter problems, the coating had visual "blotches" on small areas of the coating. The emissivity of the coating was measured and found to be about 0.71. No difference in emissivity was detected between a blotched area and an unblemished area in the infra-red images. The emissivity is consistent with the emissivities measured during the process sensitivity studies.

The same production quality rotor was heated eight times to 930° C. in the vacuum thermal cycling rig. The cooling curves were monitored for each of the cycles. Based on the cooling curves, the emissivity of the coating did not change during the thermal cycling. Visual analysis of the coating after cycling indicated that there was no spallation or debonding of the production Rene' 80 tube.

In summary, it appears that the emissivity of Rene' 80 is relatively insensitive to the spray parameters. The emissivity of Rene' 80 on GLIDCOP™ substrates varies from about 0.7–0.8. Dusting does not appear to be a significant problem. The Rene' 80 coatings being manufactured at the factory fall within this range of emissivity.

It should be obvious from the above that a thermal emissive coating on the rotor consisting of air plasma sprayed nickel based superalloy coating, such as Rene' 80 is superior in the prevention of flaking over the previously used $TiO_2$ coatings.

It is believed that any coating having ductility (i.e., strain to fail) greater than 0.05%, a close thermal expansion match to copper and steel (or to whatever metals are used in the rotor), a stable oxide in an x-ray tube environment (such as oxides of chrome, aluminium and titanium) and which has an emissivity of about 0.6 to about 0.98 will function such that rotor coating flaking will occur, if at all, only after at least 40,000 scan-seconds of usage.

While the methods and compositions contained herein constitute preferred embodiments of the invention, it is to be understood that the invention is not limited to these precise methods and compositions, and that changes may be made therein without departing from the scope of the invention which is defined in the appended claims.

What is claimed is:

1. An x-ray tube comprising:

a glass envelope;

a cathode, operatively positioned in the glass envelope;

an anode assembly including a rotor and a stator, operatively positioned relative to the rotor; and a target, operatively positioned relative to the cathode and the anode assembly, the rotor comprising:

a metal inner core;

a metal outer core; and a ductile, thermal emissive coating operatively positioned on the outer surface of the outer core wherein at least about 40,000 x-ray scan-seconds are completed prior to failure by rotor coating spalling.

2. The x-ray tube of claim 1, wherein the coating has a strain to fail greater than 0.05%.

3. The x-ray tube of claim 1, wherein the coating comprises: Rene' 80 having an emissivity of about 0.6 to about 0.98.

4. The x-ray tube of claim 3, wherein the rotor is coated with Rene'80 from about 0.2 to about 5.0 mils thick.

5. The x-ray tube of claim 2, wherein the inner core has a thermal expansion similar to steel.

6. The x-ray tube of claim 2, wherein the outer core has a thermal expansion similar to copper.

7. An x-ray system comprising;

an enclosure having oil contained therein;

an oil pump, operatively positioned relative to the enclosure for circulating oil within the system;

at least one cooling means, operatively connected to the enclosure and the oil pump, for cooling the oil;

an x-ray tube, operatively positioned inside the enclosure, for generating and directing x-rays toward a target, the x-ray tube comprising:

a glass envelope;

a cathode, operatively positioned in the glass envelope;

an anode assembly including a rotor and a stator, operatively positioned relative to the rotor; and a target, operatively positioned relative to the cathode and the anode assembly, the rotor comprising:

a metal inner core;

a metal outer core; and a ductile, thermal emissive coating operatively positioned on the outer surface of the outer core.

8. The x-ray system of claim 7, wherein the coating has a strain to fail greater than 0.05%.

9. The x-ray system of claim 8, wherein the ductile coating comprises: Rene' 80 having an emissivity of about 0.6 to about 0.98.

10. The x-ray system of claim 7, wherein the rotor is coated with Rene' 80 from about 0.2 to about 5.0 mils thick.

11. A method of manufacturing a rotor for an x-ray tube comprising the steps of:

providing a metal inner core;

providing a metal outer core;

operatively connecting the outer core to the inner core; and applying a ductile, thermal emissive coating on the outer surface of the outer core such that at least about 40,000 x-ray scan-seconds are accomplished prior to failure from coating flaking when operating in an x-ray system operating at voltages from about 80 kV to about 120 kV.

12. The method of claim 11, wherein the coating has a strain to fail greater than 0.05%.

13. The method of claim 11, wherein the ductile coating comprises: Rene' 80 having an emissivity of about 0.6 to about 0.98.

14. The method of claim 11, wherein the rotor is coated with Rene' 80 from about 0.2 to about 5.0 mils thick.

* * * * *